United States Patent [19]

Strahs

[11] 4,164,800

[45] Aug. 21, 1979

[54] COMBINATION MOP AND WRINGER

[75] Inventor: Martin P. Strahs, Lawrenceville, N.J.

[73] Assignee: Quickie Manufacturing Corp., Cinnaminson, N.J.

[21] Appl. No.: 895,738

[22] Filed: Apr. 13, 1978

Related U.S. Application Data

[63] Continuation-in-part of Ser. No. 732,054, Oct. 13, 1976, abandoned.

[51] Int. Cl.[2] ..... A47L 13/14

[52] U.S. Cl. ..... 15/119 R

[58] Field of Search ..... 15/116 R, 116 A, 119 R, 15/119 A, 120 R, 120 A

[56] References Cited

U.S. PATENT DOCUMENTS

| | | | |
|---|---|---|---|
| 2,123,329 | 7/1938 | Combs et al. | 403/383 X |
| 2,618,001 | 11/1952 | Waldrop | 15/119 R |
| 2,801,433 | 8/1957 | Palma et al. | 15/119 A |
| 2,820,232 | 1/1958 | Vosbikian et al. | 15/119 R |
| 3,040,354 | 6/1962 | Vosbikian et al. | 15/119 R |
| 3,497,901 | 3/1970 | Shipp | 15/119 R |

*Primary Examiner*—Daniel Blum

*Attorney, Agent, or Firm*—Weiser, Stapler & Spivak

[57] ABSTRACT

A combination mop and wringer comprising a handle and a replaceable strand type mop positioned at one end of the handle. A slide arm reciprocates relative to the handle from an initial position to a wringing position to push a pivotal, split ring member over the strand mop to wring out excess water. The slide arm reciprocates through a guide block having a configured opening to prevent twisting of the slide arm during movement. Reciprocation of the slide arm returns the split ring member to its initial position ahead of the strand mop. The split ring includes a pivotal connection to the slide arm and a flapper type closure to automatically complete the ring configuration prior to each mop wringing cycle. The slide arm may be provided with a locking detent suitable to releasably engage the guide block to retain the slide arm in its initial position.

9 Claims, 11 Drawing Figures

10
12
14
18
20
22
24
26
28
30
32
34
36
38
40
42
44
48
50
52
54
56
2
3

COMBINATION MOP AND WRINGER

RELATED APPLICATION

This is a continuation-in-part of application Ser. No. 732,054, filed Oct. 13, 1976, now abandoned.

BACKGROUND OF THE DISCLOSURE

The invention relates generally to the field of wet mops, and more particularly, it is directed to a combination mop with attached wringer for mop wringing purposes.

In the art of designing and using wet mops, it is the common practice to employ some type of soft, water absorbent material for the mop head construction. Because of the soft nature of the absorbent material, the material wears upon use. It is the usual practice to provide a replaceable type of mop head to facilitate easy replacement, thereby increasing the useful life of the device. It is also common practice in the art to provide some type mop wringing device to facilitate expelling a predetermined amount of water from the mop head prior to use. Prior workers in the art have designed many different types of wringing devices, some of which are integral with the water container and others of which are integral with the mop itself. The present invention is concerned with the latter type of arrangement and incorporates in combination, a handle, a mop head and a wringing device which is slidable relative to the handle and to the mop head and which functions to wring excess water out of the mop head. The devices disclosed in U.S. Pat. Nos. 3,040,355, and 3,089,171 are exemplary of prior art devices which are similar in concept to the combination mop and wringer of the present invention. All of these devices, however, have proved to be expensive in manufacture in that an elongated slot had to be fabricated in the handle for guidance purposes. The elongated slot had an additional drawback in that frequently, splinters were produced as the slot was formed to thereby create an unwanted danger.

SUMMARY OF THE INVENTION

The present invention relates generally to the field of combination wet mops and wringers and more particularly is directed to a combination mop and wringer comprising a handle, a strand mop positioned at one end of the handle and a wringing device, including a guide which is reciprocal along the handle to expel excess water from the mop head.

The present invention includes a wringing device comprising a hand grip, a configured slide arm which is reciprocal along the mop handle upon movement of the hand grip, a guide block fixed to the handle and containing a guide opening of complementary configuration to the slide arm and a split ring affixed to the end of the slide arm in a pivotal connection.

In its initial position, the hand grip is rearwardly oriented with respect to the mop handle to position the split ring behind the strand mop. Urging the hand grip forwardly along the mop handle pushes the configured slide arm through the guide block and urges the split ring over the strand mop for water wringing purposes. The hand grip is moved a distance along the mop handle sufficient to allow the split ring to travel a path that is greater in length than the length of the strand mop head. Following the water wringing action, the hand grip is reciprocated rearwardly to its initial position whereby the split ring pivots relative to the slide arm and travels over the outer periphery of the strand mop head to approach its initial position. After the split ring has cleared the strand mop head, it pivots by gravity about the end of the slide arm to its initial postion. The split ring includes a pivotal flapper which opens to enable the ring to pivot past the mop support rod when the slide arm is reciprocated to the initial position and then closes to complete the ring configuration prior to the next wringing cycle.

The combination of the cross sectional configuration of the slide arm and the restraining action of the similarly configured opening in the guide block serves to prevent torsional or twisting movement of the wringing mechanism as it reciprocates between the initial position and the strand mop wringing position.

In the second embodiment of the invention, the end of the slide arm is provided with a locking detent and the guide block is equipped with a cooperating locking face. Accordingly, when the slide arm is reciprocated rearwardly to its initial position, the locking detent is withdrawn rearwardly of the locking face, thereby preventing unwanted forward movement of the slide arm while the wet mop is in use. When it is desired to wring the wet mop, forwardly directed forces applied at the operating handle of sufficient magnitude to overcome the engagement between the detent and locking face enable the slide arm to be urged forwardly for mop wringing purposes.

It is therefore an object of the present invention to provide an improved combination mop and wringer of the type set forth.

It is another object of the present invention to provide a novel combination mop and wringer including a wringer which is reciprocal relative to the mop handle wherein the wringing mechanism comprises a configured slide arm and a guide block affixed to the mop handle wherein the guide block includes a configured guide opening to receive the slide arm therein in a sliding engagement.

It is another object of the present invention to provide a novel combination mop and wringer comprising a slide assembly incorporating hand grip means, slide arm means which are reciprocal by the hand grip means and guide block means affixed to the mop handle to prevent torsional movement of the slide assembly relative to the mop handle.

It is another object of the present invention to provide a novel combination mop and wringer comprising a slide assembly which is reciprocal relative to the mop handle and comprises a guide block, a configured cross section slide arm, which is slidable through the guide block, an end positioned, pivotal, split ring, the ring functioning to squeeze water out of the mop head when the slide assembly is reciprocated to the wringing position, the ring comprising a pivotal gate which acts to close the split ring opening upon reciprocation of the slide assembly to its initial position automatically and without conscious effort of the part of the user.

It is another object of the present invention to provide a novel combination mop and wringer of the type set forth that is simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figures 1, 2, 3:
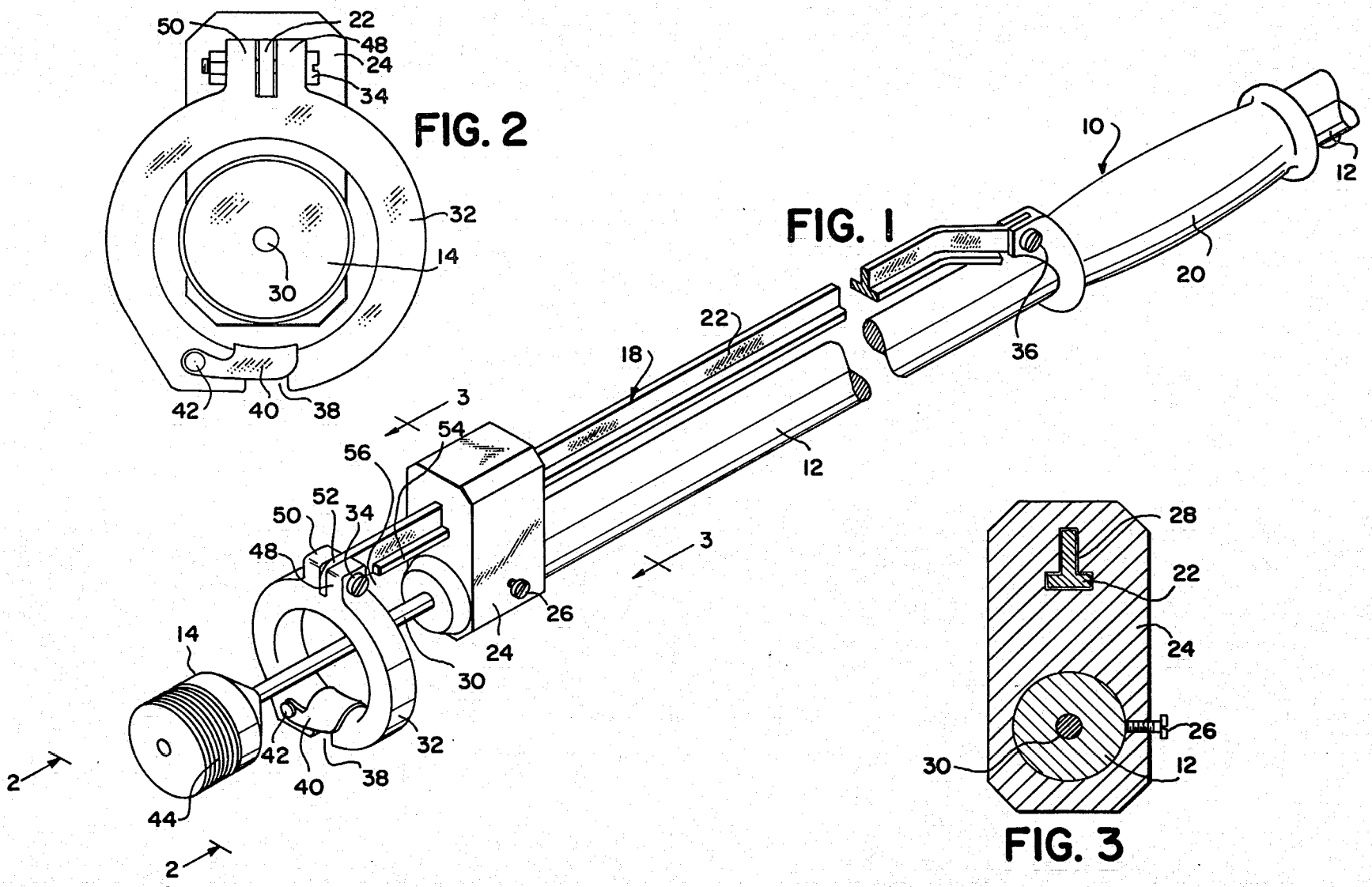
FIG. 1 is a partial, perspective view of a combination mop and wringer constructed in accordance with the teachings of the present invention.
FIG. 2 is an enlarged, cross sectional view taken along line 2—2 of FIG. 1, looking in the direction of the arrows.
FIG. 3 is an enlarged, cross sectional view taken along line 3—3 of FIG. 1, looking in the direction of the arrows.

Although specific terms are used in the following description of the sake of clarity, these terms are intended to refer only to the particular structure of the invention selected for illustration in the drawings and are not intended to define or limit the scope of the invention.

Figure 6:
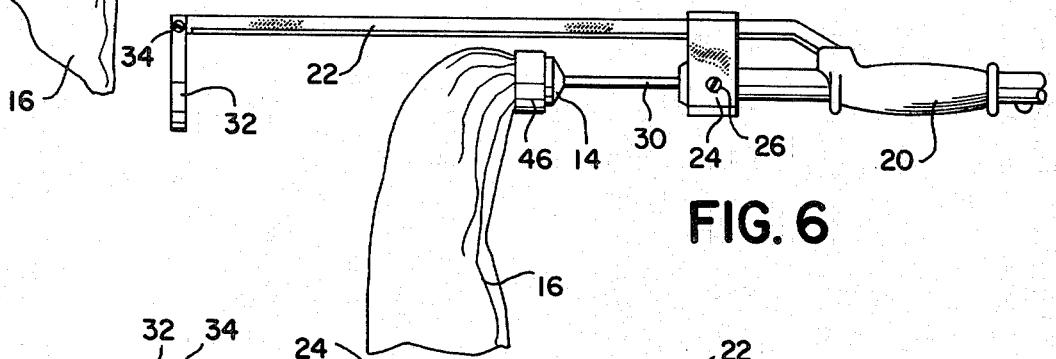
Figure 7:
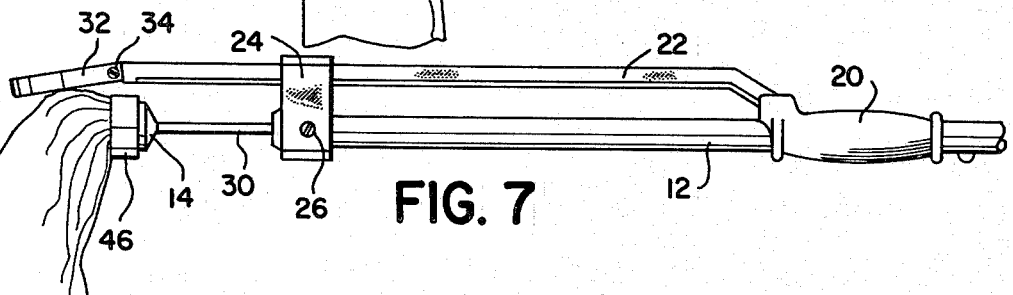

Referring now to the drawings, there is shown in FIG. 1 a combination mop and wringer 10 comprising generally a handle 12 upon which is mounted a slide assembly 18 which is arranged to reciprocally move the split ring 32 relative to the handle 12. The slide assembly 18 is reciprocal from an initial position as illustrated in FIGS. 1 and 4 to the wringing positions shown in FIGS. 5, 6 and 7.

The handle 12 terminates forwardly in a mop supporting rod 30 which is of reduced diameter from the handle 12 and which preferably is fabricated of a suitable, rigid, strong material such as steel or aluminum rod. The rod 30 forwardly carries a conventional mop connector 14 which may be provided with external threads 44 to threadedly engage the threaded socket 46 of a wet type strand mop 16. Thus, a new or replacement strand mop 16 may be readily engaged and disengaged from the combination mop and wringer 10 by simply threading and unthreading the strand mop socket 46 (FIGS. 4–8) relative to the mop connector.

Figure 4:
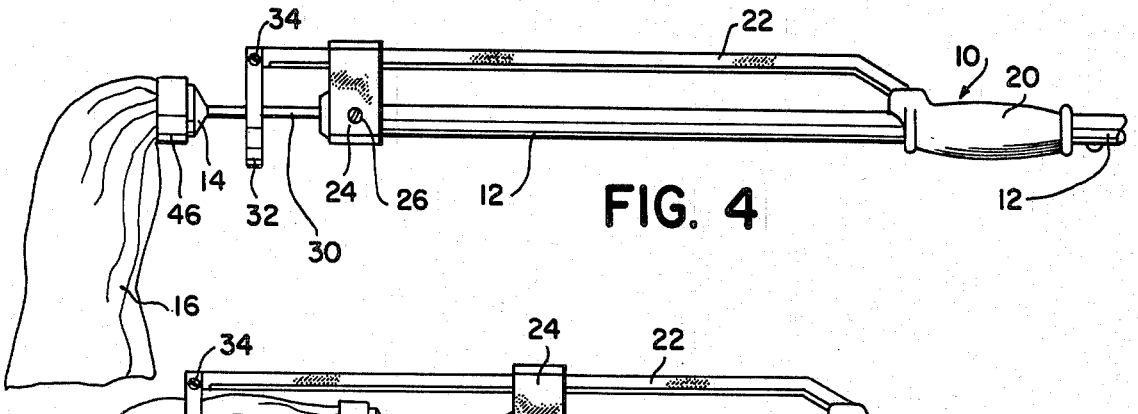
FIGS. 4–8 show various positions of the slide assembly during the cycle of use.

The slide assembly 18 includes a hand grip or sleeve 20 which is slidable longitudinally over the mop handle 12 from an initial position as illustrated in FIG. 4 to the mop wringing and retraction positions illustrated in FIGS. 5, 6, 7 and 8. Following expulsion of water by wringing the strand mop 16, the slide assembly 18 functions to retract the ring 32 over the strand mop 16 (FIG. 7) until the slide assembly 18 returns to its initial position (FIG. 4).

As best seen in FIGS. 1 and 3, the slide assembly 18 further comprises a slide arm 22, a split ring 32 which is pivotally affixed to the end of the slide arm and a fixed guide block 24. The guide block 24 is rigidly affixed to the handle 21 in a conventional manner such as by employing a set screw 26, an adhesive (not shown) or combination thereof. The guide block 24 is machined or otherwise formed to provide a shaped guide opening 28 of suitable size to receive therein in sliding engagement the slide assembly slide arm 22. The configuration of the guide opening 28 and the cross sectional configuration of the slide arm 22 are cooperating and are shaped other than round to thereby prevent rotative movement of the slide arm 22 relative to the guide block 24 as the slide assembly 18 is reciprocated. Thus, the guide opening 28 serves to prevent rotational or torsional movement of the slide arm 22 in all positions of operation as illustrated in FIGS. 4–8. The rotational movement restraint provided by the combination of the configured slide arm 22 and the cooperatively configured guide opening 28 assures easy, positive mop wringing upon each cycle of use without fear of binding, bending, tearing or other unwanted occurrence.

The slide assembly 18 terminates forwardly in a pivotal connection of the split ring 32 to allow the ring 32 to freely pivot relative to the end of the slide arm 22. A pivot pin, such as a threaded pivot bolt 34 is conventionally employed and the split ring 32 is freely pivotal about the pivot 34.

As best seen in FIGS. 1 and 2, the split ring 32 is upwardly formed to define a pair of spaced ears 48, 50 which are drilled or otherwise formed to provide transverse openings through which the pivot bolt 34 is positioned. A portion of the web 52 of the slide arm 22 is positioned between the split ring 32 and the end of the slide arm 22. It is noteworthy that the base 54 of the slide arm 22 terminates slightly rearwardly of the forward end to provide a clearance area 56 through which the split ring 32 can freely swing as it pivots during the operating cycle.

An opening 38 is provided in the periphery of the split ring 32 diametrically opposite the space defined between the ears 48, 50. The opening 38 is formed of sufficient width to allow the ring 32 to pivot past the handle extension rod 30 so that the split ring can assume the initial position prior to wringing as illustrated in FIGS. 1 and 4. A flapper 40 pivotally connects at its pivotal end to one portion of the ring periphery by a pivot pin 42. Preferably the flapper 40 is fabricated of relatively thin, light sheet metal which is bent to closely overlie and conform with the interior periphery of the ring 32. The flapper 40 is generally U-shaped in configuration as best seen in FIG. 1 and is formed to allow the base of the U to conform to and form an extension of the interior periphery of the split ring 32 for wet mop wringing purposes.

The legs of the U of the flapper 40 extend from the base and closely overlie the side periphery of the ring to provide a smooth completion thereof.

In use, after the strand mop 16 is wet in conventional manner, the slide assembly 18 is urged forwardly relative to the handle 12 from the initial position illustrated in FIGS. 1 and 4. The hand grip 20 is pushed forwardly along the handle 12 and in turn, the hand grip 20 urges the T-shaped slide arm 22 through the T-shaped slot or guide opening 28 which is provided in the guide block 24. The complementary T-shaped configurations of the slide arm 22 and the guide opening 28 serve to prevent any movement other than longitudinal sliding movement of the slide arm 22 relative to the guideblock 24. Thus, there can be no twisting or torsional movement along the path of travel as the slide assembly 18 is reciprocated from the initial position illustrated in FIG. 4 through the wringing cycle positions shown in FIGS. 5–8.

Figure 5:
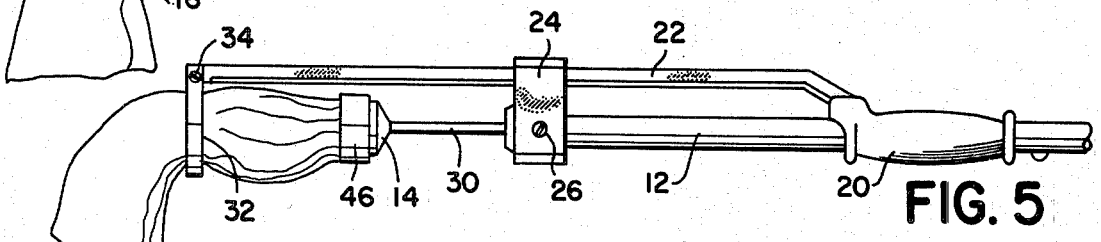
Figure 8:
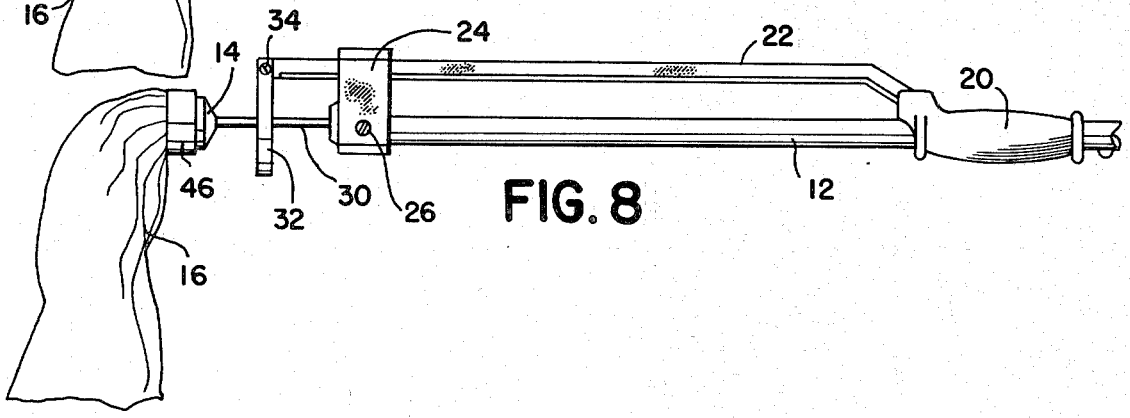

In the position of FIG. 5, the flapper 40 covers the opening 38 in the split ring 32 as the slide assembly 18 is urged forwardly to fully wring water from the strand mop 16. After the strand mop wringing operation, the slide assembly 18 is rearwardly urged relative to the handle 12 and the split ring 32 pivots to a relatively longitudinally aligned position with the slide arm 22. See FIG. 7. As illustrated, both the slide arm 22 and the pivotal split ring 32 travel rearwardly over the top periphery of the strand mop 16. When the slide assembly 18 reaches its rearwardmost position, as best seen in FIG. 8, the split ring 32 pivots by gravity about the pivot pin 34. The flapper 40 contacts the rod 30 and as the split ring 32 pivotally passes, the rod 30 pivots the flapper 40 about the pin 42. The rod 30 clears the split ring through the opening 38 and allows the split ring to fully pivot to its initial position as seen in FIGS. 1, 4 and 8. In this position, the flapper 40 also pivots to its initial position to close the opening 38 prior to the next wringing cycle.

Figure 9:
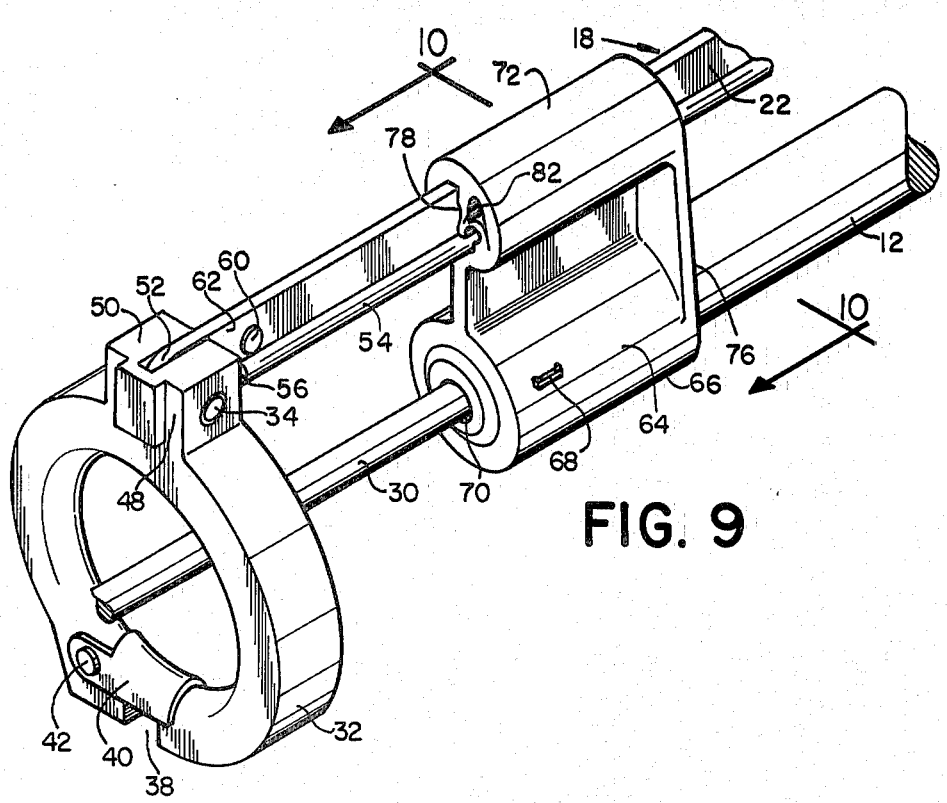
FIG. 9 is partial, perspective view similar to FIG. 1 showing a second embodiment of the invention.
Figure 10:
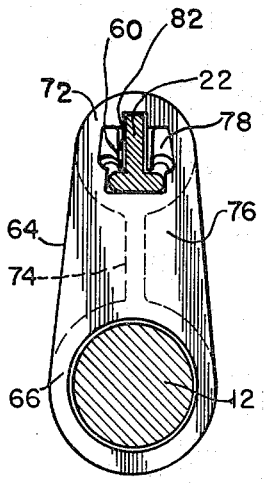
FIG. 10 is a cross sectional view taken along line 10—10 of FIG. 9.
Figure 11:
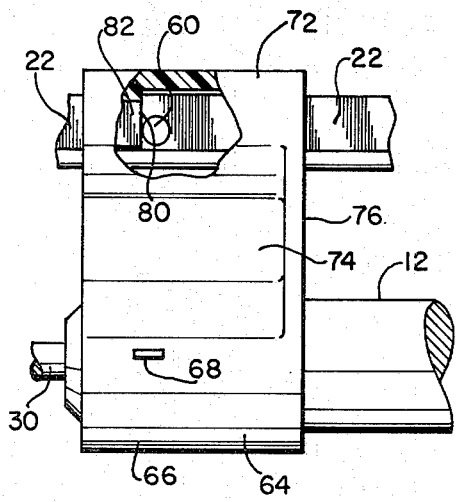
FIG. 11 is a partial, side elevational view of the guide block, partly broken away to expose interior construction details.

Referring now to FIGS. 9, 10 and 11, there is illustrated a second embodiment of the invention wherein the slide arm 22 is equipped with a transversely projecting locking detent 60 near its ring connected end 62. In this embodiment, the modified guide block 64 preferably is fabricated of an easily molded plastic material, for example, polyethylene plastic or polypropylene plastic. The guide block 64 comprises essentially a lower, barrel shaped connecting portion 66 which is generally hollow and forms a cylindrical, rearwardly facing opening within which is seated the forward end of the handle 12. The handle end and the connecting portion 66 are secured in known manner, for example, by applying a rivet or a staple 68 or alternately by employing a suitable adhesive (not illustrated). The connecting portion is molded to provide a rearward opening of size to closely overfit and receive the end of the handle 12. The connecting portion 66 is forwardly formed with a closed face having small opening 70 therein, which opening is generally concentric and through which the mop holding rod 30 forwardly extends.

The modified guide block 64 is upwardly molded or otherwise formed to provide a slide guide portion 72 to facilitate reciprocal action of the slide arm 22 therethrough. The slide guide portion 72 is spaced from the bottom connecting portion 66 in a sturdy manner, such as by utilizing the integral connecting web 74 and rear strengthening flange 76. As best seen in FIGS. 10 and 11, the slide guide portion 72 is molded, extruded or otherwise fabricated to provide a configured opening 78 of shape to slidingly receive the slide arm 22 therewithin in a manner to prevent rotation or torsional movement of the slide arm 22 relative to the modified guide block 64. The shaped channel or configured opening 78 is inwardly formed to provide a vertical locking face 80 in a position to engage the locking detent 60 when the slide assembly 18 is urged to its rearwardmost position to thereby discourage forward movement of the slide arm 22. The locking face 80 actually is the rearward terminus of a guide wall 82 which is formed in the slide guide portion 72 to define a channel for slide arm guiding purposes. The guide channel 78 defined in the modified guide block 64 is fabricated with sufficient resiliency and tolerance relative to the configuration of the slide arm 22 to permit the locking detent 60 to slip along the guide wall 82 upon the application of forces of sufficient magnitude to overcome the frictional engagement between the locking detent 60 and the guide wall 82. The transverse projection of the locking detent 60 acts to engage the detent behind the locking face 80 when the slide assembly is urged to its rearward position. In this manner, the mop (not shown) can be applied to the working surface without interference from the slide assembly. When it is desired to wring water out of the mop, the mop handle 20 is forwardly urged to move the slide assembly 18 forwardly. The application of forces sufficient to overcome the frictional engagement of the locking detent 60 upon the locking face 80 will permit forward movement of the slide assembly.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a mop and wringer of the type having a strand mop affixed at one end of a handle and a slide assembly reciprocal relative to the handle between an initial position and a mop wringing position to force a pivotally connected split ring over the strand mop to wring water from the strand mop, the improvement which comprises guide block means secured to the handle to control movement of the slide assembly, said guide block means comprising a non-circular opening which is positioned in spaced relationship from the handle, said guide block means and said opening being stationary relative to the handle; and said slide assembly comprising a slide arm wherein a portion of the slide arm is always positioned within the opening, at least a portion of said slide arm being non-circular in cross section, the slide arm terminating rearwardly at a hand grip and forwardly at the split ring, and detent means to hold the slide assembly in stationary relationship relative to the guide block means, the guide block means further comprising locking means positioned to engage the detent means, at least part of the non-circular portions of the slide arm being configured to slide within non-circular portions of the opening of the guide block means without torsional twisting, the slide arm being slidable within the opening as the slide assembly is reciprocated between the initial position and the mop wringing position;

whereby the slide assembly can not twist relative to the handle as it is reciprocated.

2. The mop and wringer of claim 1 wherein the detent means comprise a locking detent projecting outwardly from the surface of the slide arm.

3. The mop and wringer of claim 1 wherein the detent means is secured to the slide arm immediately rearwardly of the connection to the split ring.

4. The mop and wringer of claim 2 wherein the guide block construction at the said non-circular opening is adapted to permit the locking detent to slide through the opening upon the application of sufficient forces at the hand grip.

5. The mop and wringer of claim 2 wherein the guide block construction at the said non-circular opening comprises a rearwardly positioned locking face, the said locking detent being adapted to engage the locking face to discourage forward movement of the slide assembly relative to the handle.

6. In a combination mop and wringer of the type having a mop affixed at one end of a handle and a slide assembly which is reciprocal relative to the handle between an initial position and a mop wringing position to wring water from the mop comprising:

guide block means secured to the handle to guide movement of the slide assembly relative to the handle;

said guide block means comprising an opening which is positioned in spaced relationship from the handle;

the slide assembly comprising a slide arm, a portion of which is always positioned within the opening as the slide assembly is reciprocated, the slide arm and said opening being so configured that the slide arm is limited to slidable movement and detent means projecting from the slide arm to hold the slide assembly in the initial position in stationary relationship relative to the guide block means; and resilient locking means formed in the opening of the guide block means to secure the detent means is a releasable engagement, whereby the slide assembly can be secured to the said initial position to prevent unintentional movement of the slide assembly toward the wringing position.

7. The combination mop and wringer of claim 6 wherein the opening in the guide block means is defined by a resilient wall, the said resilient wall comprising the locking means.

8. The combination mop and wringer of claim 7 wherein the resilient wall terminates in a locking face and the detent means projects sufficiently to engage the locking face to discourage movement of the slide assembly toward the said wringing position.

9. The combination mop and wringer of claim 8 wherein the resilient wall is adapted flex sufficiently to permit the detent means to slip along the wall upon the application of forces of sufficient magnitude of the slide assembly to overcome the frictional engagement between the detent means and the resilient wall as the slide assembly is urged toward the wringing position.

* * * * *